US009402783B2

(12) United States Patent
Laibe

(10) Patent No.: US 9,402,783 B2
(45) Date of Patent: Aug. 2, 2016

(54) MULTI-COMPARTMENT CONTAINER FOR THE SECURE STORAGE OF THERAPEUTIC AGENTS

(71) Applicant: Erik Laibe, Torrance, CA (US)

(72) Inventor: Erik Laibe, Torrance, CA (US)

( * ) Notice: Subject to any disclaimer, the term of this patent is extended or adjusted under 35 U.S.C. 154(b) by 151 days.

(21) Appl. No.: 13/964,566

(22) Filed: Aug. 12, 2013

(65) Prior Publication Data

US 2015/0041351 A1 Feb. 12, 2015

(51) Int. Cl.
*B65D 83/04* (2006.01)
*A61J 1/03* (2006.01)

(52) U.S. Cl.
CPC ..... *A61J 1/03* (2013.01)

(58) Field of Classification Search
CPC ..... B65D 41/38; B65D 41/34; B65D 41/32; B65D 43/22; B65D 43/164; B65D 43/163; B65D 43/16; A61J 1/03
USPC ..... 206/538, 534, 534.1, 534.2, 539, 536, 206/528, 372, 373, 1.5, 349, 807, 530, 828; 220/325, 526, 520, 324, 265, 266, 260, 220/4.22, 4.23, 4.24, 4.25, 4.21; 215/6, 215/252, 250, 253
See application file for complete search history.

(56) References Cited

U.S. PATENT DOCUMENTS

| | | | | | |
|---|---|---|---|---|---|
| 4,883,251 | A * | 11/1989 | Manas | F25C 1/24 | 206/509 |
| 4,890,741 | A * | 1/1990 | Edelstein | 206/534 | |
| 5,158,209 | A * | 10/1992 | Reil et al. | 222/129 | |
| 5,782,359 | A * | 7/1998 | McAllister et al. | 206/538 | |
| 6,167,680 | B1 * | 1/2001 | Horn | 53/473 | |
| 8,162,144 | B2 * | 4/2012 | Intini | 206/532 | |
| 2002/0162842 | A1 * | 11/2002 | Pangerc et al. | 220/524 | |
| 2009/0159544 | A1 * | 6/2009 | Tune | B65D 1/0223 | 211/153 |
| 2010/0059560 | A1 * | 3/2010 | Lanum | 224/257 | |

* cited by examiner

*Primary Examiner* — Jacob K Ackun
*Assistant Examiner* — Jenine Pagan

(57) ABSTRACT

A multi-compartment container for the secure storage of therapeutic agents comprises at least a base portion having at least two cavities, said at least two cavities serving as the location where said therapeutic agents are stored, and a child resistant device. Said child resistant device allows for the secure storage of said therapeutic agents. Said child resistant device may be in the form of a typical prescription pill container cap or may be more complex, such as a combination lock. Other features may include covers to keep said therapeutic agents in place, hinges to open said multi-compartment container, and labels corresponding to related cycles for said therapeutic agents.

7 Claims, 8 Drawing Sheets

MULTI-COMPARTMENT CONTAINER FOR THE SECURE STORAGE OF THERAPEUTIC AGENTS

TECHNICAL FIELD OF THE INVENTION

The present multi-compartment container relates in general to a container for storing therapeutic agents and more specifically to a multi-compartment container for securely storing therapeutic agents such as pills, vitamins, etcetera, to be taken on a periodic basis.

BACKGROUND OF THE INVENTION

In simple form, a pill container holds a given amount of medication in a cylindrical container with a screw-on threaded lid. Such a container is generally of a size that can easily be placed in a medicine cabinet with several other similar pill containers. Such a container may also be readily carried in a purse, or in the pocket of a pair of pants.

Generally, a pill container is designed such that the lid is not easily removable, as is the case with many pill containers having a screw-on threaded lid. In other words, pill containers tend to be "child resistant." Some child resistant pill containers require the pill taker to push down on the cap and then turn the lid in order to access the pill contained therein. Others are designed such that the pill taker must squeeze on opposite ends of the cap in order to be able to turn the cap and access the pills. Yet others are designed such that both the container and the lid of the container must be perfectly aligned before the cap may be removed and access to the contents may be gained.

More complex pill containers allow for several medications, various dosages of medications, vitamins, and other therapeutic agents, to be stored in one container separated by various compartments. Medications, for example, may be stored in various compartments or cavities labeled by the day of the week or month to correspond with a concomitant cycle. The problem with these types of multi-compartment containers however, is that they lack safety mechanisms, including the types of safety mechanisms as described above. These types of containers and their contents may be easily accessed by children and others for whom the contents were not meant to be used.

There is a need in the art for a multi-compartment container that is able to store various therapeutic agents and is child resistant. It is to these ends that the present multi-compartment container has been developed.

BRIEF SUMMARY OF THE INVENTION

To minimize the limitations in the prior art, and to minimize other limitations that will be apparent upon reading and understanding the present specification, the present multi-compartment container describes a container for storing therapeutic agents that may comprise a lower portion having one or more lower cavities for storing said therapeutic agents, an upper portion having one or more upper cavities for storing said therapeutic agents, a child resistant mechanism, such that said therapeutic agents stored in said lower portion and said upper portion are secured from tampering, at least one hinge connecting said lower portion and said upper portion, one or more lower walls in said lower portion, wherein said one or more lower walls is placed such that said one or more lower walls create said one or more lower cavities, and one or more upper walls in said upper portion, wherein said one or more upper walls is placed such that said one or more upper walls create said one or more upper cavities.

Said container may further one or more lower portion covers, placed upon and releasably attached to said lower portion such that said therapeutic agents within said one or more lower cavities are secured within said one or more lower cavities, one or more upper portion covers, placed upon and releasably attached to said upper portion such that said therapeutic agents within said one or more upper cavities are secured within said one or more upper cavities, and labels for said one or more lower cavities and said one or more upper cavities.

It is an objective of the present multi-compartment container to safely and securely store a variety of therapeutic agents.

Is another objective of the present multi-compartment container to efficiently organize a variety of therapeutic agents.

These and other advantages and features of the present multi-compartment container are described herein with specificity so as to make the present multi-compartment container understandable to one of ordinary skill in the art.

BRIEF DESCRIPTION OF THE SEVERAL VIEWS OF THE DRAWINGS

Elements in the FIGS. have not necessarily been drawn to scale in order to enhance their clarity and improve understanding of these various elements and embodiments of the multi-compartment container. Elements that are known to be common and well understood to those in the industry are not depicted in order to provide a clear view of the various embodiments of the multi-compartment container. Furthermore, reference numerals have been repeated throughout the FIGS. to indicate sufficiently corresponding elements and to simplify the disclosure.

DETAILED DESCRIPTION OF THE INVENTION

In the following discussion that addresses a number of embodiments and applications of the present multi-part container, reference is made to the accompanying drawings that form a part thereof, where depictions are made, by way of illustration, of specific embodiments in which the multi-compartment container may be practiced. It is to be understood that other embodiments may be utilized and changes may be made without departing from the scope of the multi-compartment container.

Figure 1:
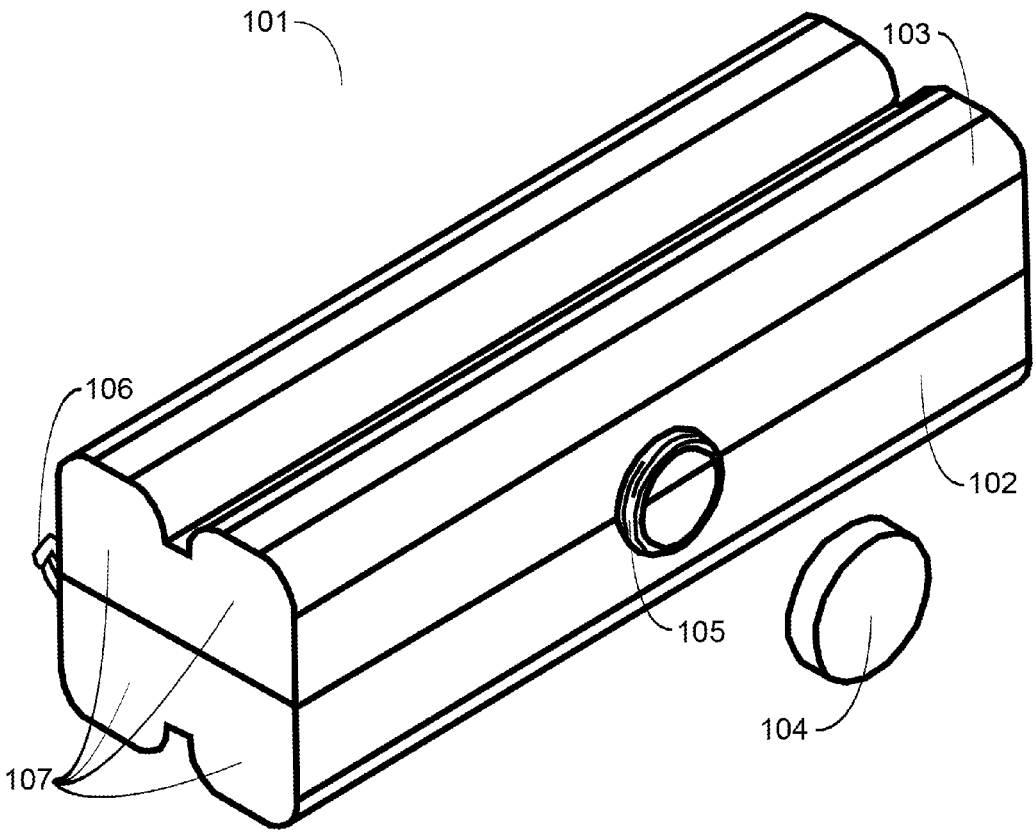
FIG. 1 is a three dimensional view of a multi-compartment container.
Figure 2:
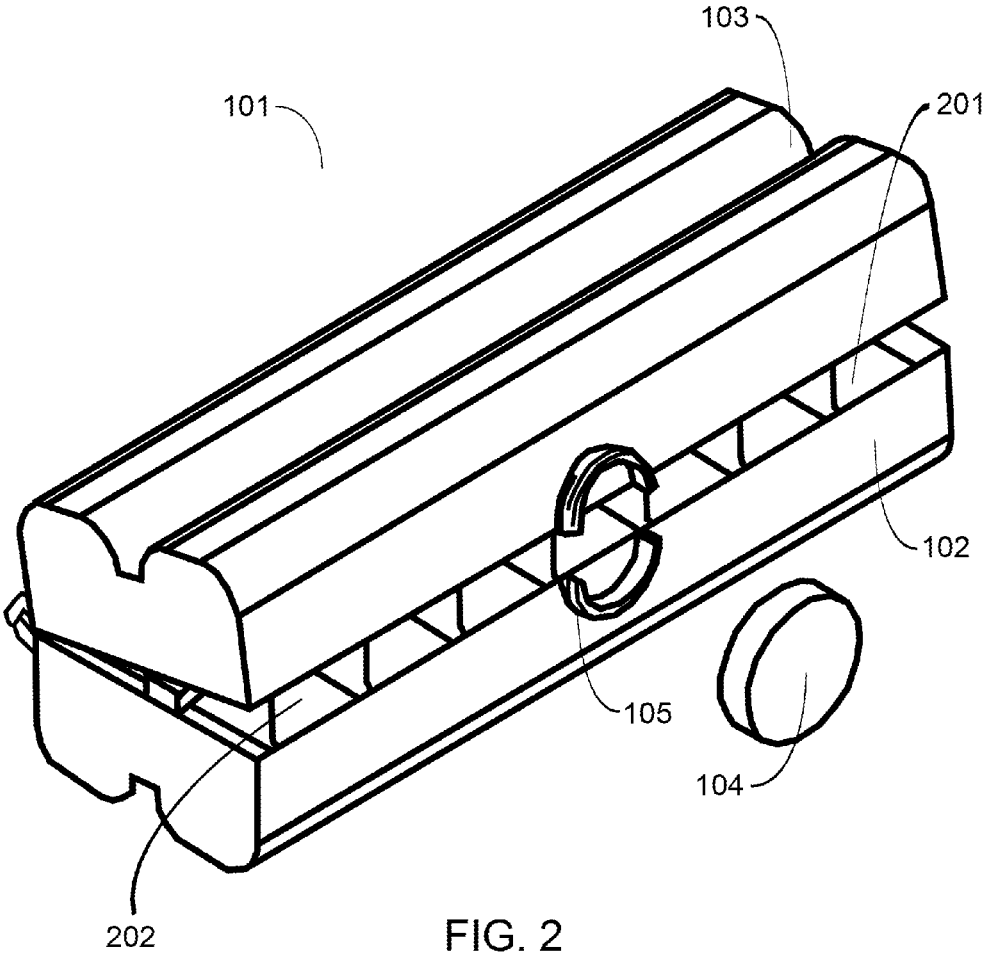
FIG. 2 is a three dimensional view of said multi-compartment container in FIG. 1, said multi-compartment container being slightly ajar.
Figure 3:
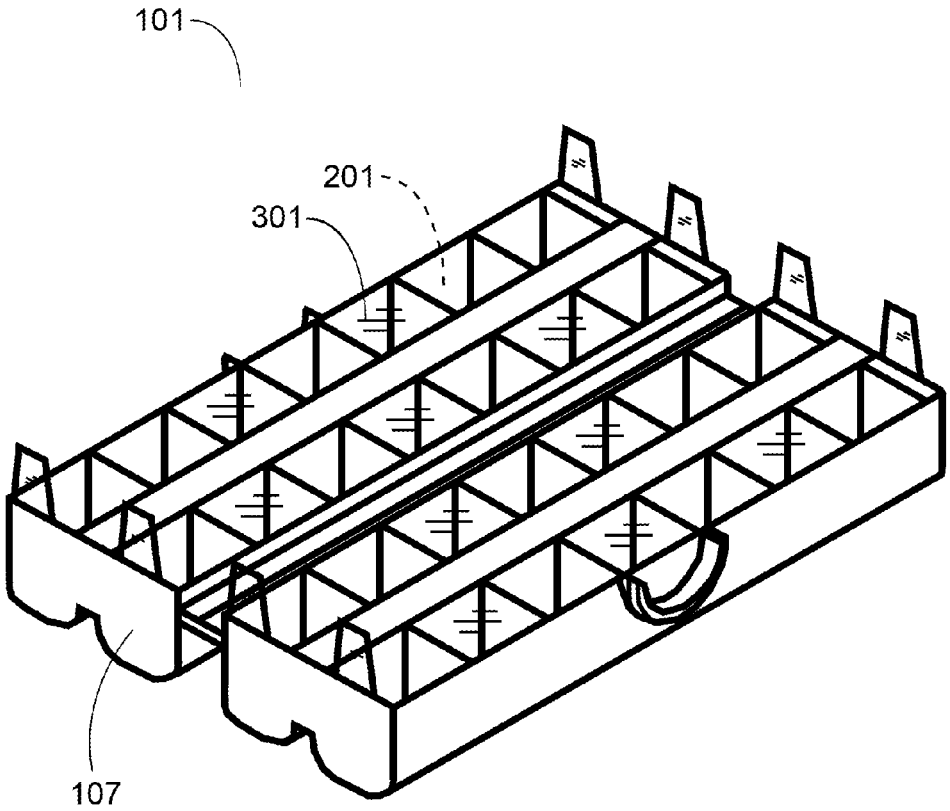
FIG. 3 is a three dimensional view of said multi-compartment container in FIG. 1, said multi-compartment container being in a substantially open position.

FIGS. 1-3 depict an embodiment of multi-compartment container 101. In particular, FIG. 1 is a three dimensional view of multi-compartment container 101. Multi-compartment container 101 may generally be comprised of lower portion 102, upper portion 103, cap 104, and hinge 106. Multi-compartment container 101 may also be constructed out of various materials including plastic, metal, or other natural or synthetic materials, or any combination of the above mentioned materials.

As depicted, lower portion 102 may be comprised of two primary sections 107. Each section 107 of lower portion 102 may run the length of multi-compartment container 101. Each section 107 of lower portion 102 may also be parallel to one another. It may also be noted that sections 107 comprising lower portion 102 have flat bottoms. Said flat bottoms may make storing multi-compartment container 101 on a shelf, for example, more practicable and stable as compared to a rounded bottom.

It may also be noted that the ends of sections 107 are also flat as depicted in FIG. 1. Similar to the flat bottoms of sections 107, flat ends may allow for multi-compartment container 101 to be more efficiently stored, as multi-compartment container 101 may be placed flush against the wall in a medicine cabinet, for example, allowing for maximal space to be utilized both within said medicine cabinet and multi-compartment container 101. Although FIG. 1 depicts each section 107 of lower portion 102 as curving upward on each side except for the ends, this is not to limit the scope of multi-compartment container 101. Rather than being somewhat rounded in shape, multi-compartment container 101 may be of a substantially rectangular shape, having no curved edges. Multi-compartment container 101 may also be more curved in shape. For example, it is within the scope of multi-compartment container 101 to have ends that are of a curvy nature rather than completely flat. Other shapes and styles may be utilized without departing from the scope of multi-compartment container 101.

Upper portion 103 may be an exact replica of lower portion 102. Thus, upper portion 103 may also be comprised of two partially curved and partially flat sections 107 as described above. Because upper portion 103 may mimic lower portion 102, this may allow for multi-compartment container 101 to rest upon a shelf, for example, upside down, and yet still be stable.

The four sections 107 depicted in FIG. 1 are not to limit the scope of multi-compartment container 101. In another embodiment, for example, lower portion 102 may be comprised of a single section 107, and upper portion 103 may also be comprised of a single section 107. In another embodiment, lower portion 102 and upper portion 103 may be comprised of a disproportionate number of sections 107, yet still be within the spirit of multi-compartment container 101.

Cap 104 may be employed to securely close multi-compartment container 101. As depicted in FIG. 1, this may be accomplished by male connecting threads 105 located on multi-compartment container 101, and female connecting threads (not shown) located on cap 104.

Cap 104 may also be of a child resistant nature. For example, when cap 104 is secured to the entirety of multi-compartment container 101, cap 104 may be removed from multi-compartment container 101 by pressing down on cap 104 and then turning such that cap 104 is removed. In another embodiment, cap 104 may be removed from multi-compartment container 101 by pressing simultaneously on both sides of cap 104 and then turning. In yet another embodiment, cap 104 may be of a nature such that it cannot be removed unless it is aligned in a certain configuration. Other similar caps may be employed by multi-compartment container 101. In another embodiment, however, another child resistant device may be used that would make it difficult for access to be gained. This may include a combination lock, or design such that the multi-compartment container may be opened by pressing on either end first.

Hinge 106 may be of a nature such that it solidly connects upper portion 103 and lower portion 102 along the length of the rear side of multi-compartment container 101. Although not fully depicted in FIG. 1, hinge 106 may run the entire length of multi-compartment container 101. In another embodiment, hinge 106 may be a series of one or more separate connectors, similar to the hinges found on a typical household door. In yet another embodiment, hinge 106 may not be employed at all. Rather, lower portion 102 may be configured to receive upper portion 103 such that upper portion 103 merely snaps into place onto lower portion 102 or vice versa. In this embodiment, a security feature may be added such that a button or a lever may be engaged in order to separate said upper portion 103 and lower portion 102, such that multi-compartment container 101 retains child resistant properties.

FIG. 2 is a three dimensional view of multi-compartment container 101, said multi-compartment container 101 being slightly ajar. FIG. 2 reveals additional features that may comprise multi-compartment container 101, i.e. cavities 201 and walls 202. It is within said cavities 201 that various therapeutic agents may be stored. As shown in FIG. 2 the front section 107 of lower portion 102 is comprised of seven cavities 201 aligned side by side and separated by walls 202. In another embodiment a different number of cavities 201 may be employed. For example, it is within the spirit of the invention that front section 107 of lower portion 102 may be comprised of as little as one cavity 201 while upper portion 103 is comprised of a concomitant number. In another embodiment, lower portion 102 and upper portion 103 may be comprised of a disproportionate amount of cavities 201.

It may also be noted that the member comprising male connecting threads 105 may be divided into separate parts during the manufacturing process with one hemisphere located on lower portion 102 and another hemisphere located on upper portion 103. This "broken" design may allow strategic placement of cap 104.

FIG. 3 is a three dimensional view of multi-compartment container 101 in a substantially open position. As noted above, each section 107 in FIG. 3 contains seven cavities 201, however, this is not to limit the scope of multi-compartment container 101. Again, each section 107 may contain more or less cavities 201 depending on the type and duration of therapeutic agents employed by the particular multi-compartment container 101.

FIG. 3 further depicts section covers 301. Section covers 301 may serve to help keep therapeutic agents contained in cavities 201 secured in place when opening and closing multi-compartment container 101. Section covers 301 may be of a transparent nature in order to see the actual therapeutic agents contained in multi-compartment container 101. However, in another embodiment, section covers 301 may be designed such that they serve as a visual block to the therapeutic agents contained in multi-compartment container 101. Thus, although as depicted in FIG. 3 section covers 301 are clear, this is why it may be more accurate to depict cavities 201 as being represented by a dotted line in the event that an opaque cover 301 were to be employed by multi-compartment container 101.

Furthermore, section covers 301 and/or cavities 201 themselves may be labeled. One form of labeling may include days of the week, such as Sunday through Saturday. Utilizing the embodiment depicted in FIG. 3, each cavity 201 may correspond to each day of the week, and being as there are four sections 107 each having seven cavities 201, four weeks, or twenty-eight days of therapeutic agents may be stored in multi-compartment container 101. Other embodiments may utilize fewer or more cavities 201 and sections 107. Thus, it is within the scope of multi-compartment container 101 to be comprised of two cavities 201 or 365 cavities 201. Said cavities 201 may correspond to a cycle, such as a treatment cycle using varying doses of medication, or a calendar cycle such as hours of the day, days of the week, days of a month, months of a year, etc.

Figure 4:
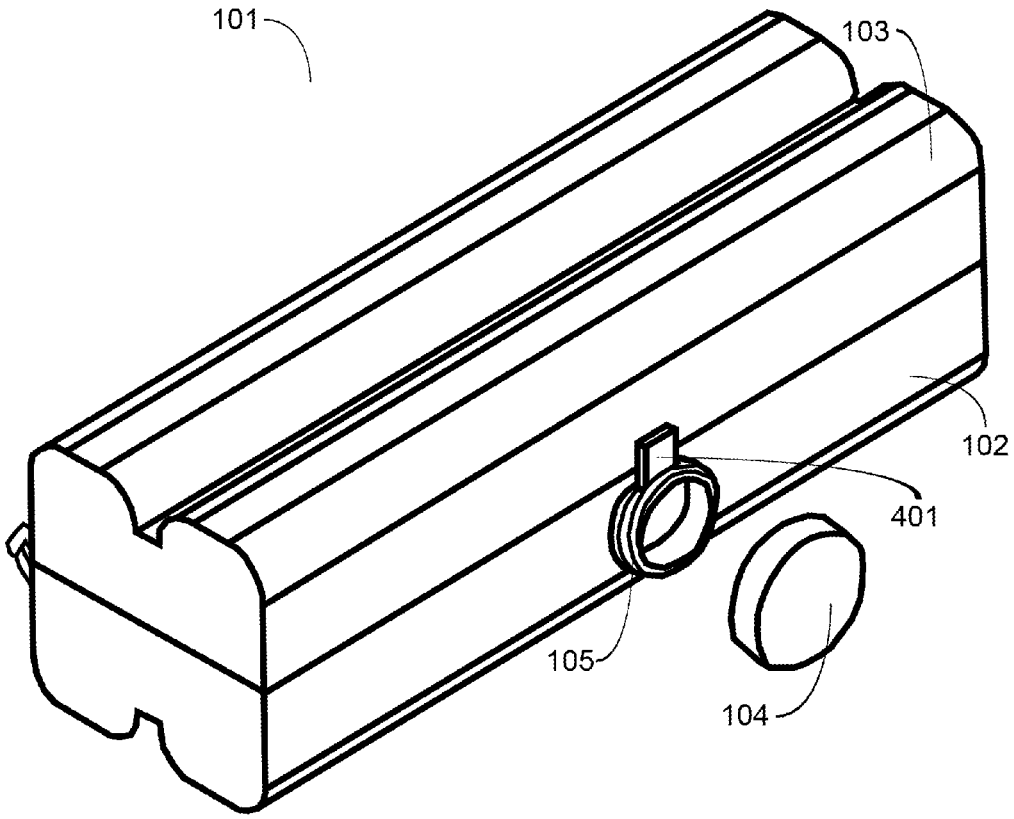
FIG. 4 is a three dimensional view of an alternative embodiment of a multi-compartment container.
Figure 5A:
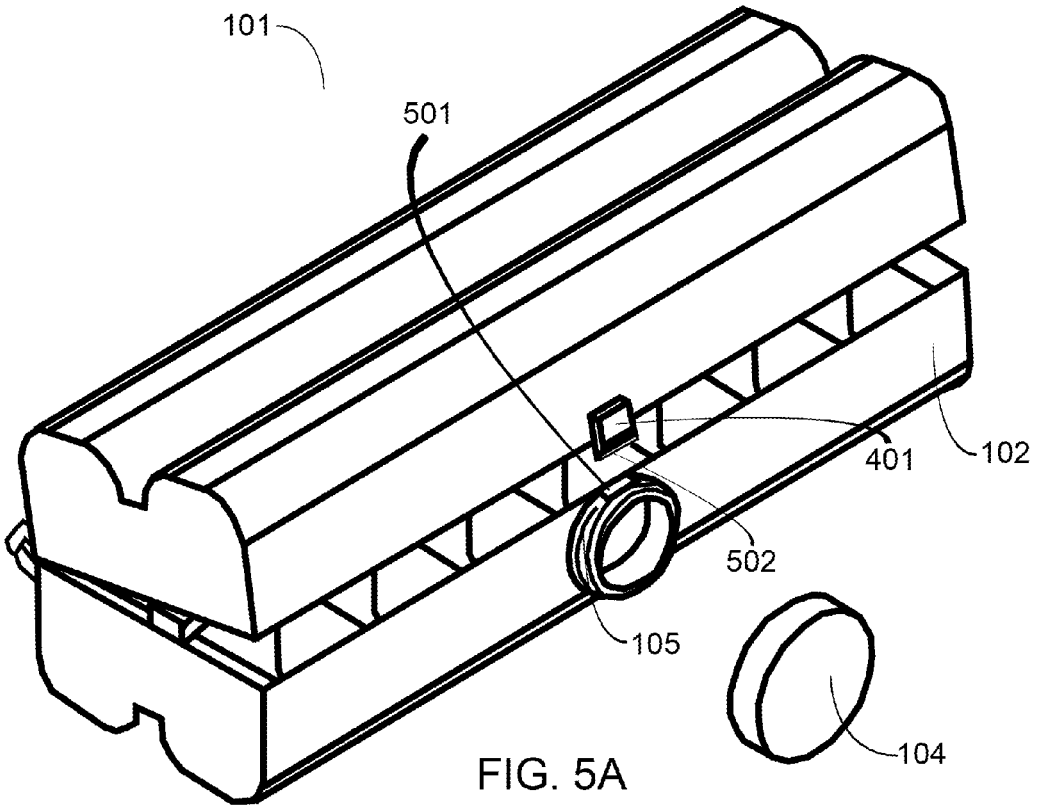
FIG. 5A is a three dimensional view of said multi-compartment container in FIG. 4, said multi-compartment container being slightly ajar.
Figure 5B:
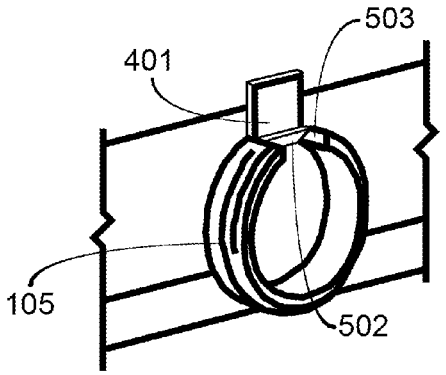
FIG. 5B is a close-up three dimensional view of an alternative embodiment of male connecting threads.
Figure 6:
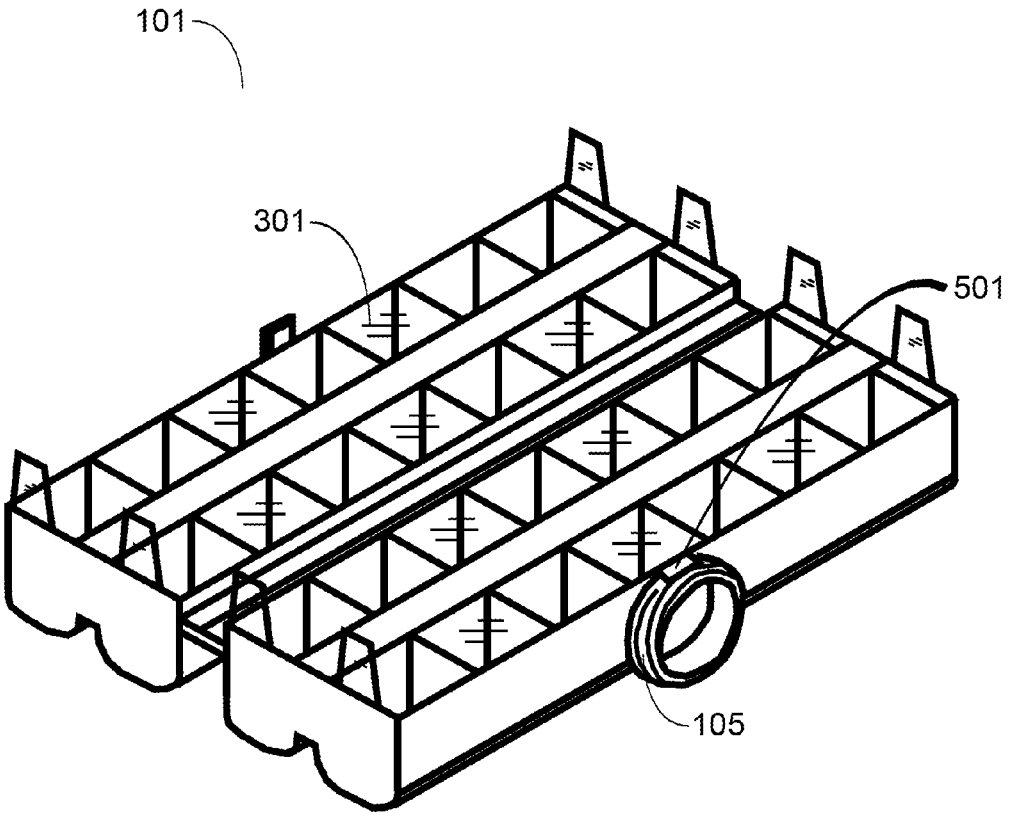
FIG. 6 is a three dimensional view of said multi-compartment container in FIG. 4, said multi-compartment container being in a substantially open position.

FIGS. 4-6 depict an alternative embodiment of multi-compartment container 101. FIGS. 4-6 are of substantially the same nature as FIGS. 1-3, with some minor differences in the configuration of cap 104 and male connecting threads 105. As shown in FIG. 4, the circular configuration of male connecting threads 105 may be located entirely on lower portion 102. FIG. 4 additionally depicts tab 401, which may be solidly connected to upper portion 103, and extend toward lower portion 102. When multi-compartment container 101 is closed, as shown in FIG. 4, tab 401 may come to rest and be secured in aperture 501 (not shown) located on an upper portion of male connecting threads 105.

After tab 401 is secured in aperture 501, cap 104 may be attached. As discussed above, cap 104 may comprise a variety of child resistant designs. In FIG. 4 however, the child resistant design of tab 401 secured within male connecting threads 105 may not necessitate further child resistant safety measures, however this is not to limit the spirit of multi-compartment container 101. In another embodiment, several different child safety designs may be employed on a single multi-compartment container 101 to further secure therapeutic agents from tampering.

FIG. 5A is a three dimensional view of multi-compartment container 101 shown in FIG. 4, said multi-compartment container 101 being slightly ajar. FIG. 5A depicts further detail of the alternative embodiment utilizing tab 401, lip 502, and aperture 501. From this perspective, it may be noted how tab 401 may be placed in or taken out of aperture 501. Tab 401 may further be comprised of lip 502 and a spring mechanism (not shown). Lip 502 may be a slight protrusion from tab 401, such that when tab 401 is inserted into aperture 501, more force may be necessary to fully close and secure multi-compartment container 101. Conversely, when opening multi-compartment container 101, it may be necessary to depress lip 502 which may be held up by said spring mechanism in order to open multi-compartment container 101.

FIG. 5B is a close-up three dimensional view of an alternative embodiment of male connecting threads 105. In this embodiment it may be noted that rather than having aperture 501, male connecting threads may utilize opening 503 to achieve a similar result. Rather than aperture 501 receiving tab 401, opening 503 may alternatively receive tab 401 in a similar manner, namely tab 401 may come to rest in opening 503 rather than be placed in a hole, as depicted by aperture 501 depicted in FIG. 5A. Cap 104 may thereafter be placed on male connecting threads 105 to secure the contents of multi-compartment container 101. Cap 104 may be placed such that when fully in place, multi-compartment container 101 may not be opened, as lip 502, which may protrude from tab 401, may catch cap 104. As such multi-compartment container 101 may not be opened unless cap 104 is removed after which lip 502 may not be blocked by cap 104.

FIG. 6 is a three dimensional view of multi-compartment container 101 shown in FIG. 4 in a substantially open position. It may be noted that FIG. 6 is representative of one embodiment of multi-compartment container 101. Other embodiments may include multi-compartment-container sans covers 301. Another embodiment may include the alternative male connecting threads 105 and opening 503 as discussed in FIG. 5B, rather than the embodiment disclosing aperture 501 in FIG. 6.

Figure 7:
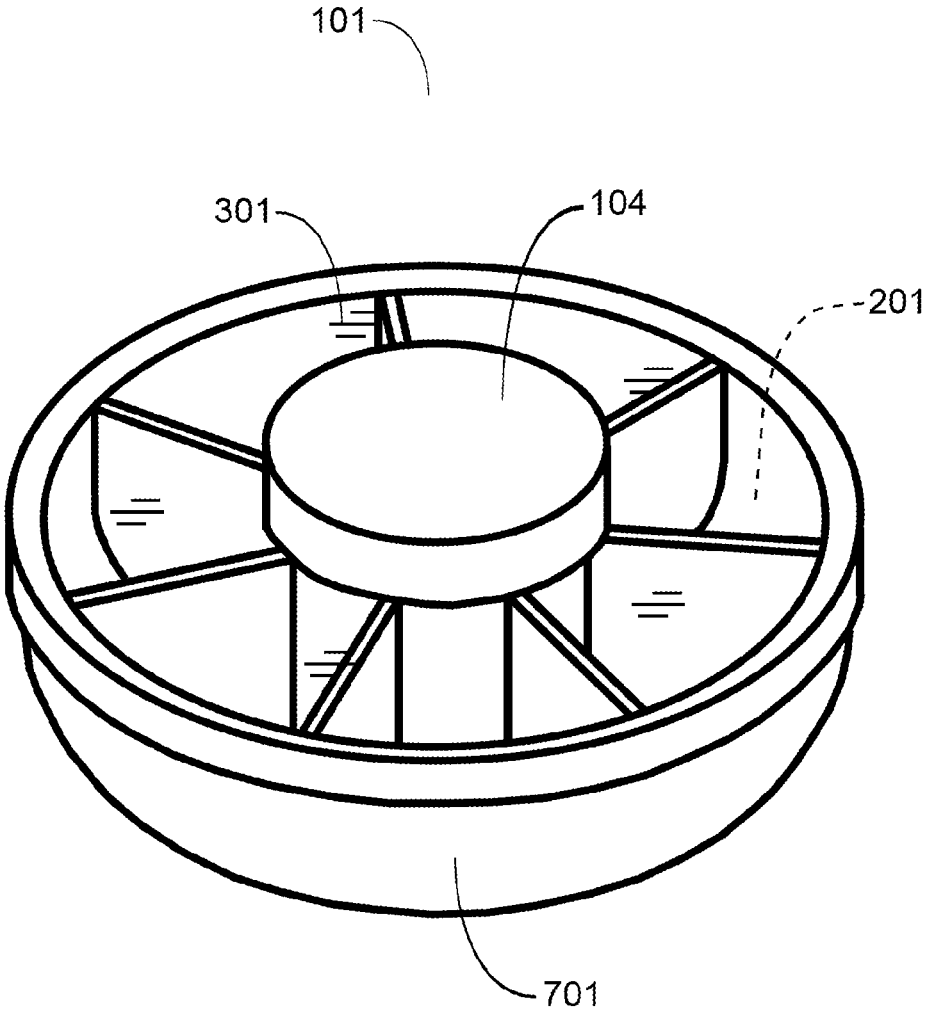
FIG. 7 is a three dimensional view of another alternative embodiment of a multi-compartment container.

FIG. 7 is a further alternative embodiment of multi-compartment container 101. Unlike the embodiments discussed thus far having both upper portions 103 and lower portions 102, the embodiment depicted in FIG. 7 is comprised of a singular base portion 701. This embodiment further comprises an alternative cover 301, which may be placed over base portion 701 such that the contents of base portion 701 are secured in the event that multi-compartment container 101 were to be jostled or flipped. Multi-compartment container 101 may then be further secured with cap 104. Cap 104 may be of the same child resistant designs as discussed above. Other child resistant techniques may be utilized, however, to keep therapeutic agents contained in said multi-compartment container 101 safe.

FIG. 7 depicts seven cavities 201 which comprise base portion 701 which may logically correspond to the days of the week. In other embodiments, however, base portion 701 may be comprised of more cavities 201 or less cavities 201, and said cavities 201 may correspond to other cycles as discussed above. Furthermore, the shape of multi-compartment container 101 may vary. As such, another embodiment similar to that depicted in FIG. 7 may be of a substantially square shape. Such other embodiments do not digress from the essence of multi-compartment container 101.

Figure 8:
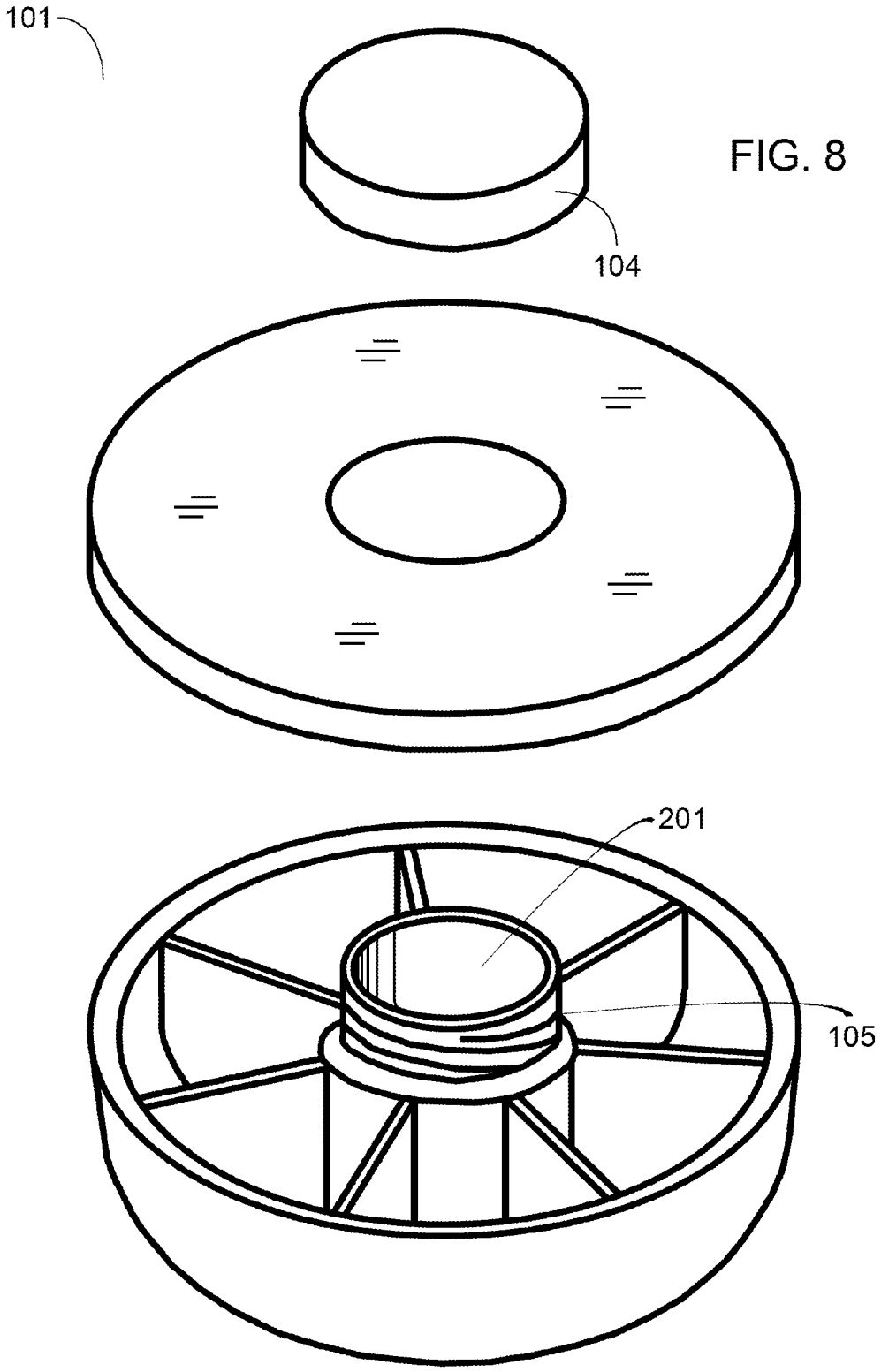
FIG. 8 is a three dimensional exploded view of said multi-compartment container in FIG. 7.

FIG. 8 is an exploded view of said multi-compartment container 101 in FIG. 7. In this exploded view, it may be noted how cap 104 may be secured to multi-compartment container 101, i.e., male connecting threads 105 and female connecting threads on cap 104 (not shown). It may also be noted that an additional cavity 201 may be utilized immediately beneath where cap 104 is placed.

A multi-compartment container for the secure storage of therapeutic agents has been described. The foregoing description of the various exemplary embodiments of the multi-compartment container has been presented for the purposes of illustration and disclosure. It is not intended to be exhaustive or to limit the multi-compartment container to the precise form disclosed. Many modifications and variations are possible in light of the above teaching without departing from the spirit of the multi-compartment container.

DESCRIPTION OF THE REFERENCE SYMBOLS

101: multi-compartment container
102: lower portion
103: upper portion
104: cap
105: male connecting threads
106: hinge
107: section
201: cavity
202: wall
301: cover
401: tab
501: aperture

502: lip
503: opening
701: base portion

What is claimed is:

1. A container for storing therapeutic agents, comprising:

a lower portion defined by two lower sections that run a length of the container and parallel to one another, each lower section curving upwards on each side along a length of each lower section, and having a flat bottom surface, wherein each lower section includes a plurality of lower cavities for storing the therapeutic agents;

an upper portion defined by two upper sections that run the length of the container and parallel to one another, each upper section curving downwards on each side along a length of each upper section, and having a flat top surface, wherein each upper section includes a plurality of upper cavities for storing the therapeutic agents; and a locking mechanism including:

male connecting threads comprising: a lower threaded component protruding from the front of the lower portion, and an upper threaded component protruding from the front of the upper portion, wherein the lower and upper threaded components are positioned to align when the container is closed; and a cap that includes female connecting threads, which secures with the male connecting threads formed by the lower and upper threaded components when the container is closed.

2. The container of claim 1, wherein said container further comprises at least one hinge connecting said lower portion and said upper portion.

3. The container of claim 1, wherein said container further comprises one or more lower walls in said lower portion, wherein said one or more lower walls is placed such that said one or more lower walls create said lower cavities.

4. The container of claim 3, wherein said container further comprises one or more upper walls in said upper portion, wherein said one or more upper walls is placed such that said one or more upper walls create said upper cavities.

5. The container of claim 1, wherein said container further comprises one or more lower portion covers, placed upon and releasably attached to said lower portion such that said therapeutic agents within said lower cavities are secured.

6. The container of claim 5, wherein said container further comprises one or more upper portion covers, placed upon and releasably attached to said upper portion such that said therapeutic agents within said upper cavities are secured.

7. The container of claim 1, further comprising labels for said lower cavities and said upper cavities.

* * * * *